United States Patent [19]

McKay et al.

[11] Patent Number: 4,778,433

[45] Date of Patent: Oct. 18, 1988

[54] TOY CREATURE HAVING A TONGUE FOR CAPTURING PREY

[75] Inventors: Robert S. McKay, Morton Grove; Dennis R. Dahm, Streamwood; Robert S. McLennan, Hillside, all of Ill.

[73] Assignee: Up-Trend Design, Wood Dale, Ill.

[21] Appl. No.: 25,107

[22] Filed: Mar. 12, 1987

[51] Int. Cl.[4] ..... A63H 3/36

[52] U.S. Cl. ..... 446/304; 446/339

[58] Field of Search ..... 446/304, 320, 339, 359, 446/368, 395, 490, 330, 336, 390, 391; 273/1 GG, 1 G

[56] References Cited

U.S. PATENT DOCUMENTS

| | | | |
|---|---|---|---|
| 366,441 | 7/1887 | Wetzell | 446/353 X |
| 4,257,610 | 3/1981 | Ptaszek et al. | 446/304 X |
| 4,469,327 | 9/1984 | Ulrich et al. | 446/330 X |
| 4,575,350 | 3/1986 | Hippely et al. | 446/368 |
| 4,669,997 | 6/1987 | Kulesza et al. | 446/304 X |

*Primary Examiner*—Mickey Yu

*Attorney, Agent, or Firm*—Kinzer, Plyer, Dorn, McEachran & Jambor

[57] ABSTRACT

The disclosed toy creature defines a mouth, a tongue, and means for manipulating the tongue between a substantially extended straight orientation projecting from the mouth, and a coiled orientation totally within the mouth. As so manipulated, the tongue may be coiled around and entrap some toy prey, and draw the prey back toward and into the mouth, as if to eat the prey. The mouth may be opened and closed, correlated to the movement of the tongue, particularly in opening the mouth wide only upon the tongue being recoiled, to carry the captured prey into the opened mouth. The tongue may be formed of links, pivoted together end-to-end; and a push-pull member, extended substantially the full length of the tongue links, but offset laterally from the pivot connections, may be used for manipulating the tongue. The push-pull member may be connected to only the outboard end link, may slide freely through guide holes in the intermediate links, and may be pulled or pushed, via an operating member, at the inboard end of the push-pull member. The operating member may be connected to the tongue, and mounted to be rotated also, to change the direction the tongue will be coiled. A handle connected to the operating member may be manually manipulated by someone using the toy.

13 Claims, 4 Drawing Sheets

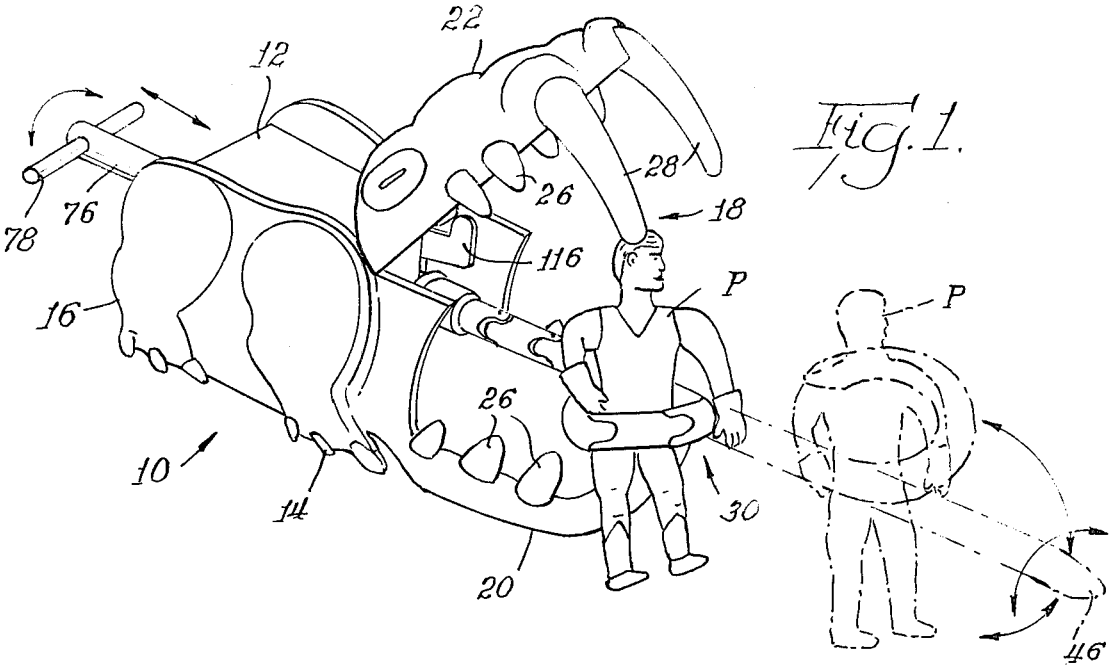
Fig. 1.
Fig. 11.
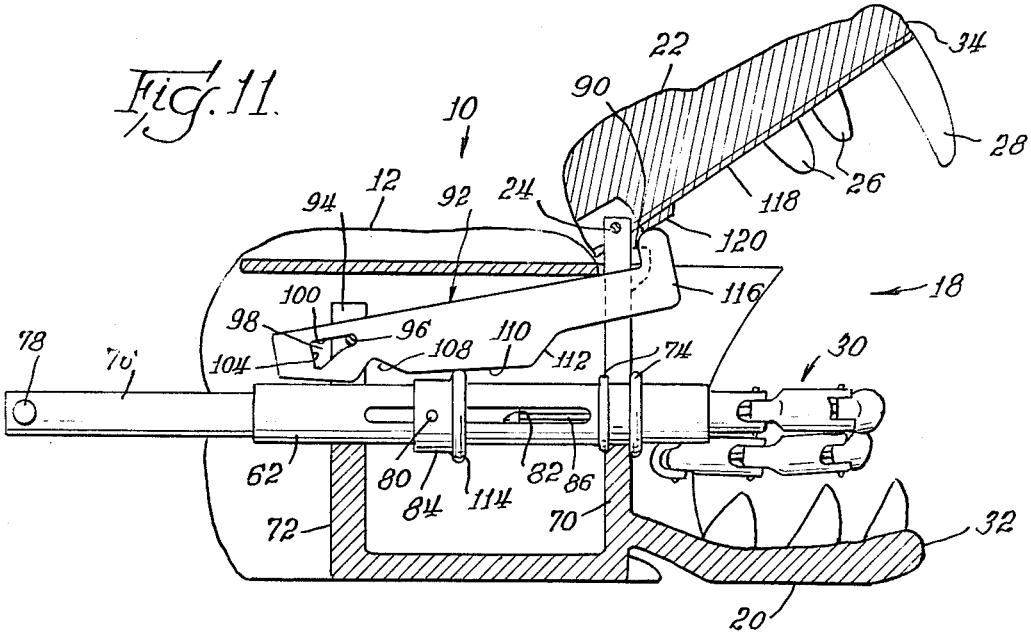
Fig. 12.
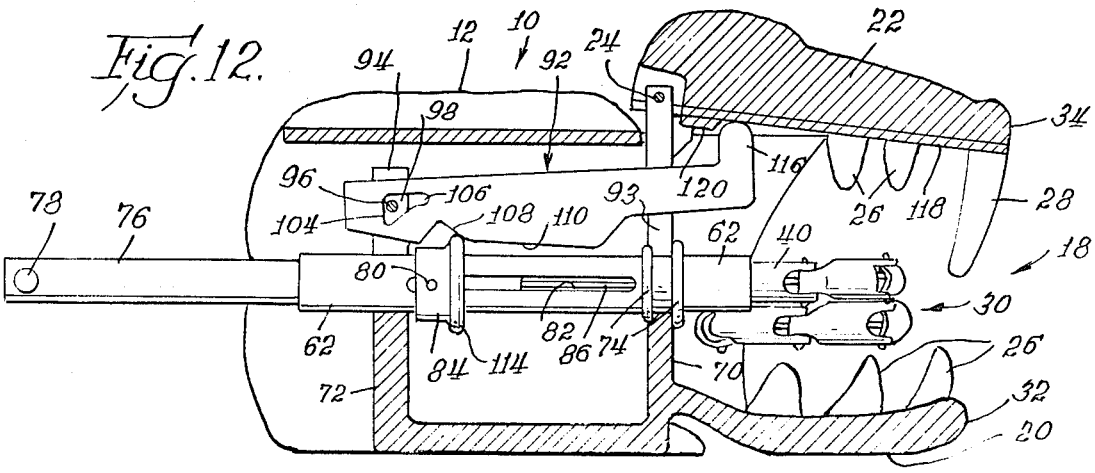

242
244
238
15.
86
262
210
22
118
240
258
116
261
102
24
112
111
70
92
12
98
96
80
82
262
72
78
76

242
246
244
262
238
256
230
16.
86
240
258
261
262
76
78

256
242
288
86
238

116
112
92
110
108
106
100
102
98
104

230
288
262
86
244
16.
256

TOY CREATURE HAVING A TONGUE FOR CAPTURING PREY

BACKGROUND OF THE INVENTION

Nature has given its many creatures, different means for capturing its prey, for feeding itself. One more interesting means is the use of its tongue, that is quite long relative to the size of the body and/or head, and that is capable of being extended from the mouth to the prey, while the mouth may not move at all toward the prey. The common frog and lizard are two such creatures that have this active tongue for catching prey.

SUMMARY OF THE INVENTION

The present invention provides a toy that can be operated to simulate the capturing feats of such creatures in nature, in that a "tongue" normally located in a "mouth", can be extended to reach far beyond the mouth, and can be manipulated to entrap some toy "prey", and can draw the prey back to the mouth, and size permitting, into the mouth, which then can be closed over the captured prey, as if in eating the prey.

The inventive toy creature thus has structure defining a mouth, a tongue, and means securing one end of the tongue in the mouth. The tongue is elongated compared to the size of the mouth, to provide that the tongue may be extended to far beyond the forward edges of the mouth. Means allow for the manipulation of the tongue, between a substantially straight orientation projecting from the mouth, and a coiled orientation . . . to entrap some toy prey and to draw the prey back toward the mouth.

The mouth may be opened and closed, and the tongue may be coiled to fit entirely within the mouth, when the mouth is closed.

The means for manipulating the tongue operates in association with the means for opening and closing the mouth, to open the mouth wide upon the tongue being recoiled to carry any captured prey toward and into the mouth.

The tongue may be formed of a plurality of links, each of relatively short length compared to the length of the tongue, the links being pivoted together successively end-to-end.

A push-pull member extended substantially the full length of the tongue, and connected to the end link at the free end of the tongue, may serve as the means for manipulating the tongue.

The push-pull member may be mounted to slide relative to each of the remaining tongue links at locations laterally offset relative to the link pivot means.

A handle may be manually gripped and moved by the user of the toy, being coupled to the other end of the push-pull member.

The handle may be moved both axially in line with the extension of the tongue, to extend and recoil the tongue; and rotatably about the longitudinal axis of the tongue, to shift the direction about which the tongue will coil.

BRIEF DISCRIPTION OF THE DRAWINGS

FIG. 1 is a perspective view of the toy creature forming the invention, showing the creature in use in capturing a toy prey; specifically illustrating in phantom the creature's tongue fully extended from its mouth and adjacent the far side of a toy prey, and then also illustrating in solid the creature's tongue partically wrapped around the toy prey and in a position just about to draw it into the opened mouth.

FIG. 11 is an elevational sectional view, similar to FIGS. 2, 4, 6 or 10, except showing the several operating components near the end of the second half of the capturing cycle, where the tounge is almost completely recoiled and in the mouth, but the mouth is yet almost fully opened to accept the captured toy prey, which is not illustrated for clarity of disclosure.

FIG. 12 is an elevational sectional view, similar to FIGS. 2, 4, 6, 10 or 11, except showing the several operating components near the end of the second half of the capturing cycle, where the tounge is almost completely recoiled and in the mouth and just as the mouth has been closed.

DETAILED DESCRIPTION OF ILLUSTRATED EMBODIMENTS

Figure 3:
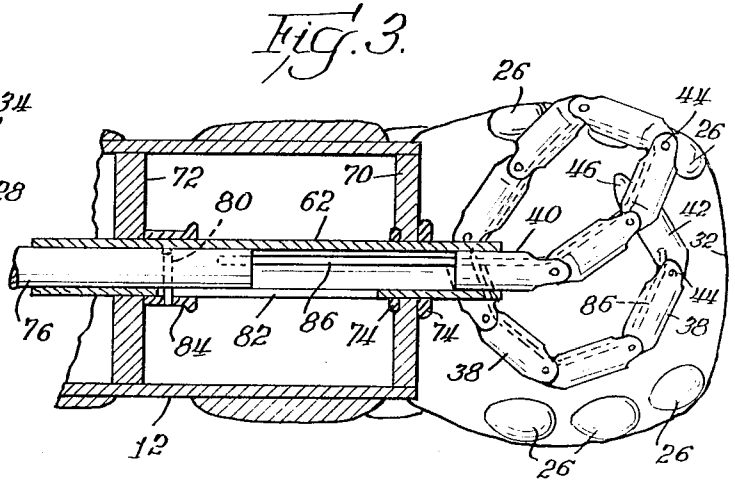
FIG. 3 is a sectional view, as seen generally from line 3—3 of FIG. 2.

FIG. 1 shows a toy creature 10 that can be operated to simulate the capturing feats of several natural creatures, such as a frog or lizzard, that use active tongues to capature its prey. The toy creature 10 illustrated has a body 12 with front legs 14 and rear legs 16 at its sides, and has a mouth 18 at its front. The mouth 18 is illustrated with a lower stationary jaw member 20 and an upper movable jaw member 22, hinged to the body 12 at 24. Teeth 26, including the menacing canies 28, project from the jaw members, toward one another and across the mouth 18.

Figure 2:
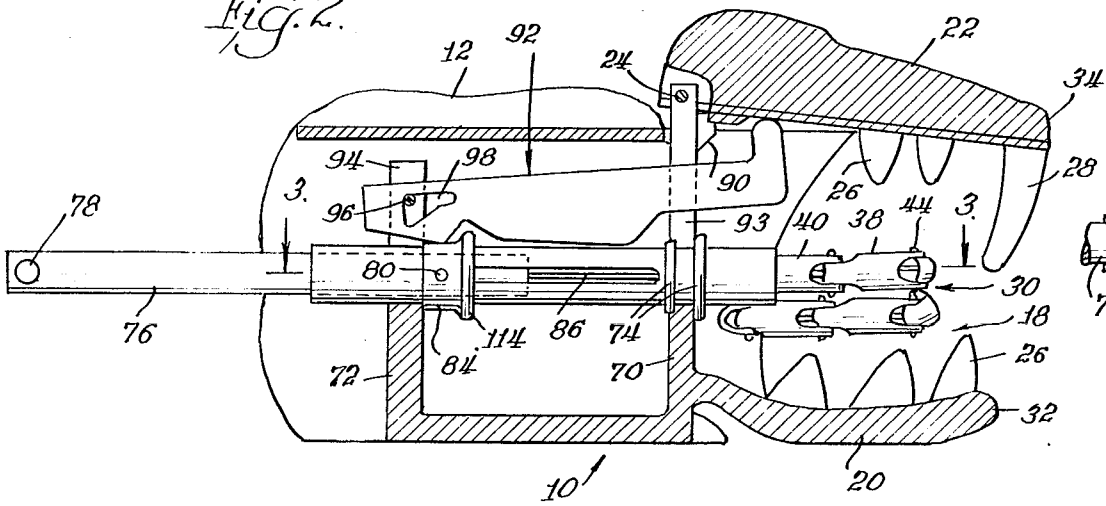
FIG. 2 is an elevational sectional view of the toy creature of FIG. 1, illustrating it at the start of the capturing cycle, with the mouth closed and the tongue coiled within the mouth.
Figure 5:
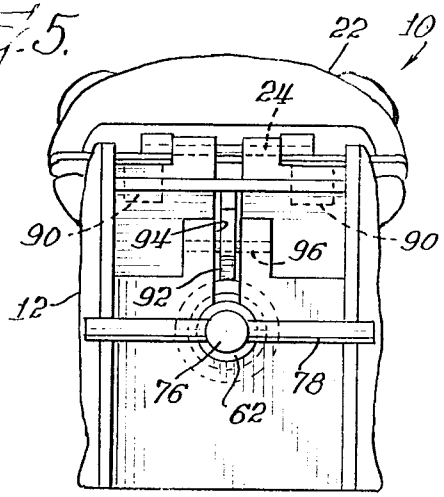
FIG. 5 is a rear elevational view of the toy creature of FIGS. 2 or 4.
Figure 4:
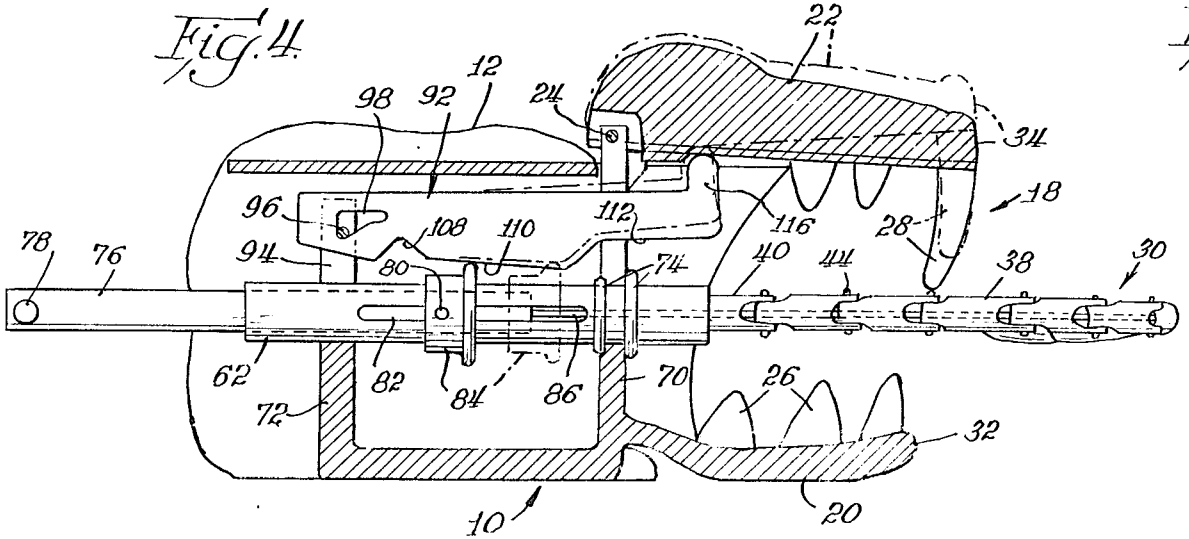
FIG. 4 is an elevational sectional view, similar to FIG. 2, except illustrating the several operating components during the first half of the capturing cycle, corresponding to where the tongue is being uncoiled to project from the mouth and the mouth is yet only partically opened.
Figures 6, 7, 8, 9, 10:
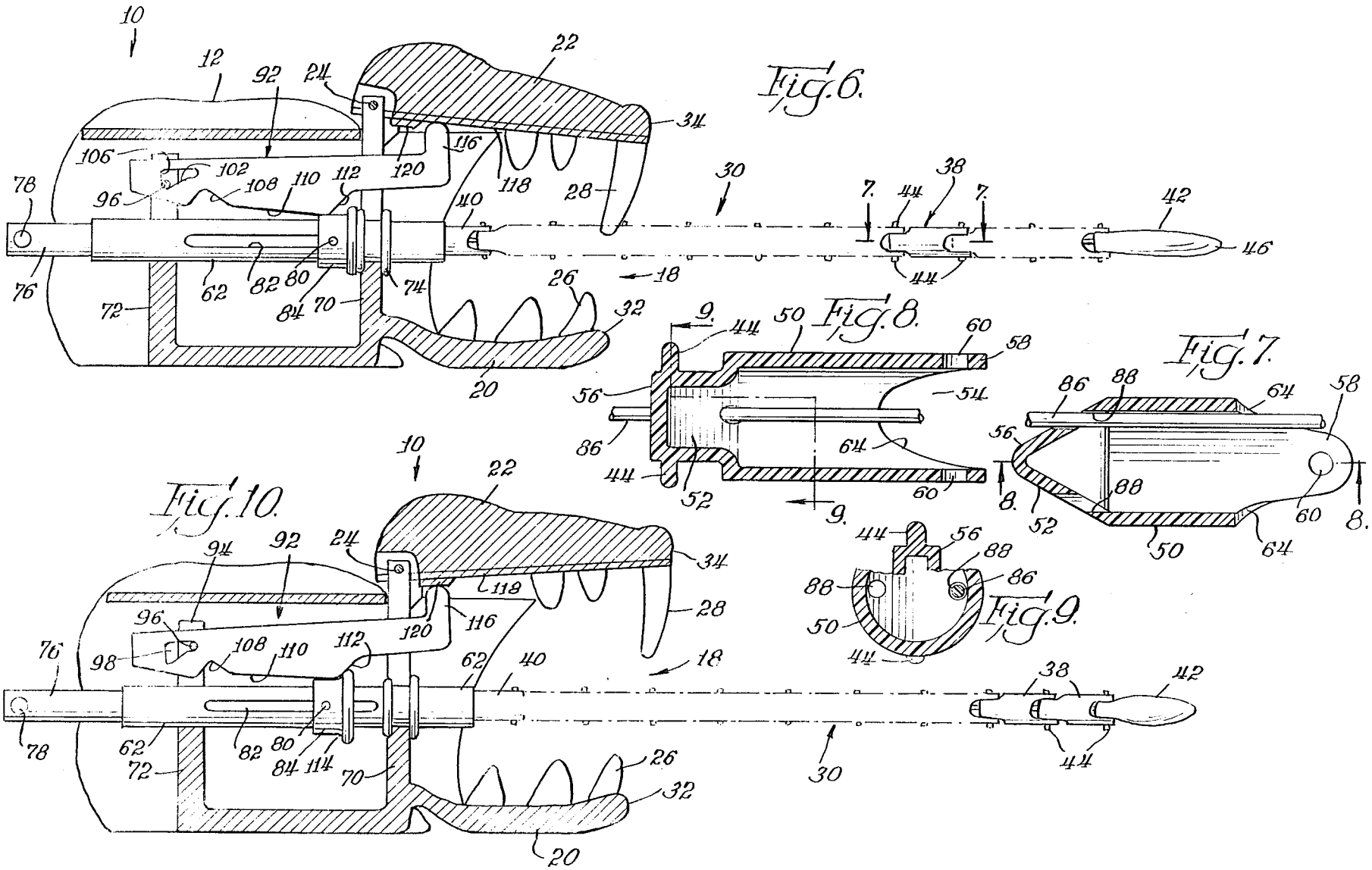
FIG. 6 is an elevational sectional view, similar to FIGS. 2 or 4, except showing the several operating components near the end of the first half of the cycle, where the tounge is completely uncoiled and fully projected from the mouth, as was also illustrated in phantom in FIG. 1.
FIG. 7 is an enlarged fragmentary sectional view, as seen generally from line 7—7 in FIG. 6, illustrating one of the components forming the creature's tongue.
FIG. 8 is a fragmentary sectional view, as seen generally from line 8—8 in FIG. 7.
FIG. 9 is a fragmentary sectional view, as seen generally from line 9—9 in FIG. 8.
FIG. 10 is an elevational sectional view, similar to FIGS. 2, 4 or 6, except showing the several operating components at the beginning of the second half of the capturing cycle, where the tounge is initially being recoiled, although it is yet extensively projected from the mouth, and the mouth is about to be opened fully.

A tongue 30 is supported within the mouth 18 of the toy creature 10, and is very much elongated relative to the size of the mouth 18. This allows the tongue 30 to be extended or straightened, to project far beyond the front edges 32 and 34 of the jaw members, as is illustrated in FIGS. 1, 6 and 10. The tongue 30 however may be coiled on itself to fit entirely within the same edges of the jaw members, when the mouth is closed (see FIGS. 2, 3 and 12).

The tongue 30 is formed of a plurality of intermediate links 38, and inboard and outboard end links 40 and 42 respectively. The links 38, 40 and 42 are pivoted together end-to-end, to swing about generally parallel pivot posts 44, as the tongue 30 is moved between the extended and coiled configurations. For added realism, the tongue links 38, 40 and 42 may cooperate with one another to provide that the overall exterior shape of the tongue is basically cylindrical, terminating at a rounded point 46 on the outboard end link 42.

Each intermediate link 38 may have an annular middle section 50, a substantially closed end 52, and an substantially open end 54. The end 52 is tapered in from one set of opposing sides (see FIG. 7), and is necked down from the opposite set of sides (see FIG. 8), to a wedged corner 56 smaller in both height and thickness than the axial extension of the middle section 50. The pivot posts 44 are axially aligned, and project diametrically from the wedged corner 56, to radially just beyond the axial extension of the middle section 50. The opposite open link end 54 has opposed ears 58 defined somewhat as axial extensions of the middle section 50; and diametrically aligned openings 60 are formed in the ears 58. The pivot posts 44 and openings 60 of each intermediate link 38 lie symetrically of a single plane extended along the longitudinal center axis of the link.

The inboard end link 40 (see FIG. 3) has no closed end or posts, but instead terminates along the annular middle section; and the annular middle section is secured rigidly relative to and within a tube 62. The inboard end link 40 does have an open end 54, along with the opposed ears 58 and openings 60.

The outboard end link 42 does not have the opposed ears 58, but instead has a closed end opposite to the necked down end 52; and the rounded point 46 simulating the end of the tounge 30, is formed on such closed end. The end link 42 does have the tapered and necked down end 52, and the opposed posts 44.

In the embodiment illustrated, the links 38, 40 and 42 may be made of somewhat flexible but structurally sound material, such as plastic. Thus, the ears 58 of one link may be flexed outwardly somewhat, to fit over the posts 44 of the adjacent link, until the posts snap in place within the openings 58. The cooperating posts 44 and openings 60 connects such adjacent links 38, 40 and 42 together, end-to-end, to allow the tongue to articulate between the extended and coiled orientations.

The side edges 64 of the ears 58 are cut away, to allow the adjacent links to swing about the cooperating posts 44 and openings 60, over a wide angle to each side of the straightened or extended position of the links. Thus, any adjacent pair of the links 38, 40 and 42 may be angled sharply relative to one another, defining an included angle between the adjacent links perhaps as small as between 45 and 90 degrees, to allow the tongue to be coiled quite tightly. Thus, perhaps only four, five or possibly six adjacent links may be needed to define a full 360 degree loop of the tongue, without interference between the adjacent links.

The inboard end link 40 of tongue 30, as noted, is secured within tube 62, to be in effect unitary therewith. The tube 62 itself is supported to rotate about its longitudinal axis, relative to wall structures 70 and 72 of the body 12; but is axially restrained relative to the body, such as by annular ribs 74, formed off of the tube, trapping the body wall 70 therebetween. A shaft 76 fits in the tube 62 from the end opposite the inboard tongue link 40, and has a handle 78 thereon. The shaft 76 is supported to move axially relative to the tube 62; but a diametric pin 80 (see FIG. 3) projected from an opening in the shaft is received in an axial slot 82 in the tube 62, to key the shaft 76 nonrotatably relative to the tube 62. An annular collar 84 axially movable on the tube 62, is axially restrained relative to the shaft 76, by the pin 80 being received within an opening in the collar.

A push-pull member 86 is extended substantially the full length of the tongue 30, being fitted through axially aligned openings 88 in the tapered and necked down ends 52 of the links. The inboard end of the push-pull member 86 is connected to the shaft 76. The push-pull member 86 is axially slidable within and relative to all of the links, except the outboard end link 42; and is secured at its outboard end to the end link 42, at a location laterally offset from a longitudinal plane through its posts 44. The through openings 88 formed in each link are also laterally offset from the longitudinal plane defined by the posts 44 and openings 60 of each link. Although two openings 88 are illustrated in each link, only a single push-pull member 86 is used . . . and is fitted through only one of the openings in each link.

The push-pull member 86 is flexible to bend about its longitudinal axis, but is also capable of pushing in an axial direction without collapsing. This allows the axial shifting of the shaft 76, to be transmitted via the push-pull member 86 along the length of the tongue to the outboard end link 42. The push-pull member 86 may be formed of a slim solid rod of flexible but durable plastic (such as nylon), or by a woven cable of steel.

In the extended or straightened orientation of the tongue 30, the push-pull member 86 is also straight; and the shaft 76 is inserted forwardly as far as it will go into the tube 62. Upon withdrawing the shaft 76 from the tube 62, the reduced length of the push-pull member 86 yet remaining within the tongue 30, causes the adjacent links to articulate about the respective cooperating posts 44 and openings 60, to coil the tongue 30 in the lateral direction toward the push-pull member 86.

Generally, to recoil the adjacent links from a straightened tongue configuration, the outboard link 42 will articulate first, relative to its adjacent link, and each next successive inboard pair of links will then be articulated . . . until all of the links are coiled. To straighten a coiled tongue, the inboard pairs of adjacent links will be straightened first, and each next successive pair of outboard links will then be straightened . . . until all of the links are aligned and the tongue is straightened.

Each of the links 38, 40 and 42 may be elongated somewhat compared to its cross section; but such elongation is only a small part of the overall length of the tongue 30. However, because of the many links, the tongue 30 is very much elongated relative to the size of the mouth 18, to project far beyond the front edges 32 and 34 of the jaw members. As noted, perhaps only four, five or possibly six adjacent coiled links are needed to define a full 360 degree loop and more links than this may be used to form the tongue so that the tightly coiled tongue may define more than one loop. The second and any subsequently formed loop of coiled tongue will generally underlie the coiled loop just formed, to have such coiled loops lie adjacent one another as a helix. The free play betweeen the cooperating posts 44 and openings 60, supporting the links relative to one another, generally will allow this cooperation; although if necessary, a slight tilt may intentionally be made between the alignment of the two posts 44 relative to the two openings 60 on each link.

The upper jaw member 22 normally is biased by gravity to the closed position, where it butts against a stop 90 formed on the body wall 70. In this position, the jaw members 20 and 22 are approximately parallel, and well spaced apart. An operative lost motion connection is made between the movable upper jaw member 22 and the shaft 76, to have the jaw member 22 open about pivot pins 24, automatically but differently, upon the tongue being uncoiled from, and being recoiled into, the mouth 18.

Figure 17:
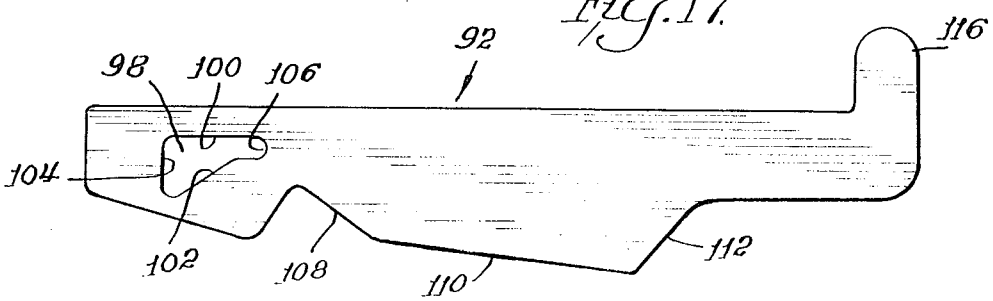
FIG. 17 is an enlarged elevational view, of the lost motion actuator bar used to open and close the mouth of the toy creature, disclosed in the previous figures.
Figure 15:
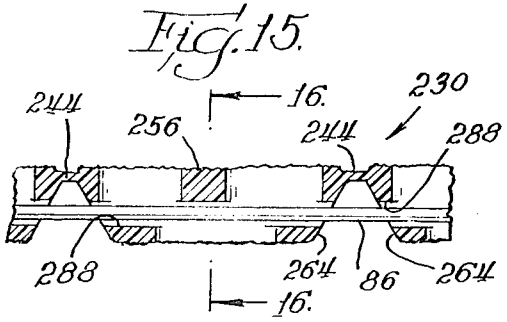
FIG. 15 is a fragmentary sectional view, as seen generally from line 15—15 in FIG. 13.

An actuator bar 92 (see FIG. 17 also) is guided within slots 93 and 94 in the body walls 70 and 72 respectively, to move only within a vertical plane extended forwardly and rearwardly of the mouth. A pin 96, fixed to the body wall 72, is fitted within larger opening 98 in the bar 92; thereby providing that the bar can be moved with a certain degree of lost motion until the pin is trapped against one or more of the edges of the opening. The opening has its upper edge 100 aligned generally with the direction of movement of the shaft 76, while its lower edge 102 is inclined upwardly toward the front, from elongated inboard vertical edge 104 to shortened outboard vertical edge 106.

When the bar 92 is moved outwardly to bring the pin 96 against the elongated inboard edge 104, the bar 92 can be moved vertically until the pin 96 butts against either upper edge 100 or lower edge 102. However, when the bar 92 is moved inwardly to bring the pin 96 against the shortened outboard edge 106, the bar 92 can not be moved any appreciable distance vertically, as the pin is already close to or butting the edges 100 and 102. Accordingly, the bar 92 can then only be pivoted about the pin 96.

A notch 108 and adjacent camming surfaces 110 and 112 are formed on the lower edge of the bar 92, each being adapted to cooperate with annular camming rib 114 on collar 84, during respective operative positions of the components. An upstanding finger 116 on the outboard end of the actuator bar 92 is adapted to underlie, and during respective operative positions of the components, abut the underside surfaces of the upper jaw member 22, just forwardly of the pivot pins 24.

The camming surface 110, outwardly from the notch 108, slopes toward the guide tube 62 and away from the bar finger 116, angled in one direction relative to the back and forth movement of the actuator camming rib 114. The camming surface 112 slopes in the opposite direction relative to the movement of the actuator camming rib 114 . . . away from the guide tube 62 and toward the bar finger 116.

With the pin 96 against the elongated inboard edge 104, the bar finger 116 underlies surface 118 on the underside of the upper jaw member 22. With the pin 96 against the shortened outboard edge 106, the bar finger 116 underlies surface 120 on the underside of the upper jaw member 22; which surface 120 is immediately next to the pivot pins 24. The surfaces 118 and 120 extend somewhat radially from the pivot pins 24, but they are offset laterally from one another, with surface 120 being closer to the guide tube 62 or more in the path of movement of the collar camming rib 114, when the mouth is closed.

Figure 13:
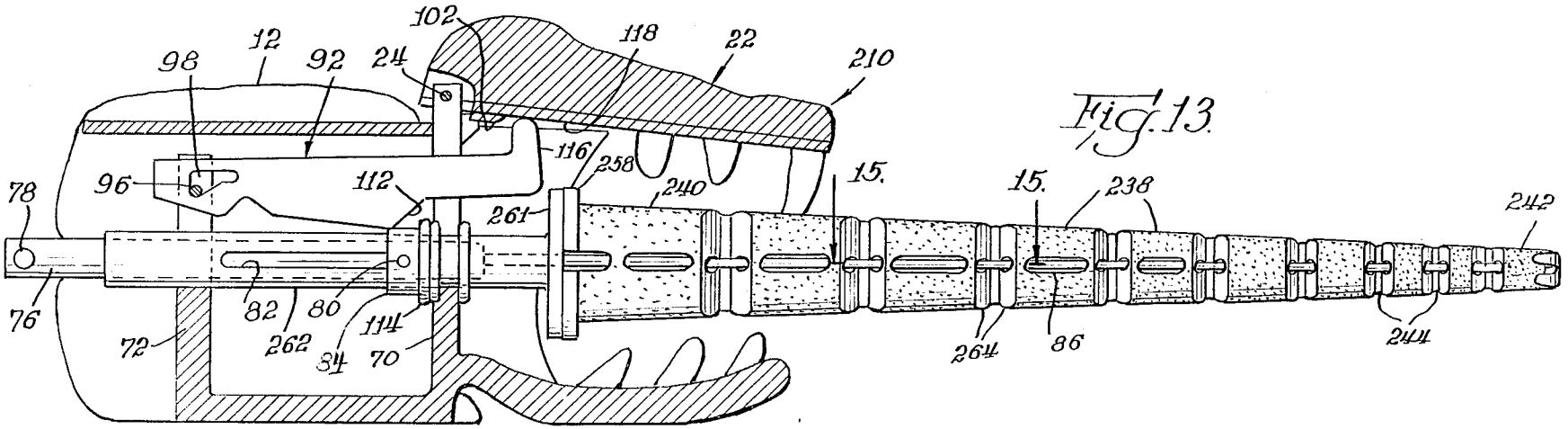
FIG. 13 is an elevational sectional view, similar to FIG. 6, except showing a second embodiment of the tongue and its mounting component, and illustrating them and other operating components, near the end of the first half of the cycle where the tounge is completely uncoiled and fully projected from the mouth.
Figure 14:
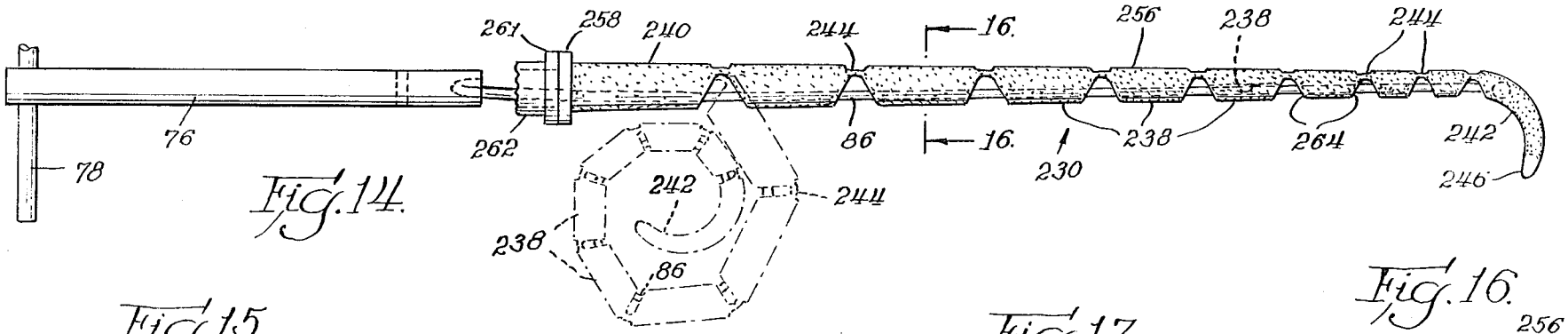
FIG. 14 is a top plan view of the tongue and its mounting component of FIG. 13, with the mouth not illustrated for clarity of disclosure and showing also in phantom, the tongue being fully coiled to fit within the mouth.
Figure 16:
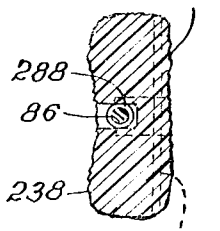
FIG. 16 is a fragmentary sectional view, as seen generally from line 16—16 in FIG. 14.

An alternate form of toy creature 210 is illustrated in FIG. 13, having many structural components identical to those used in the toy creature 10 of FIGS. 1–12; and accordingly such are numbered the same. However, the tongue 230 illustrated in FIGS. 13–16 is different, being formed as basically a unitary piece.

The tongue 230 has a plurality of intermediate links 238, and inboard and outboard end links 240 and 242 respectively, hinged together end-to-end across narrowed down generally parallel hinge sections 244. For added realism, the outboard tongue link 242 may be curved as a hook 246, curved in the direction the tongue 230 is to coil.

Each intermediate link 238 may have a somewhat full middle section 250, and opposite ends 264 tapered down to narrowed unitary hinge sections 244. The inboard link 240 and outboard link 242 each has only one hinge section 244 and tapered down end 264 to the hinge section. The tapered ends 264 allow the adjacent links to swing about the hinge sections 244, with any adjacent pair of the links 238, 240 and 242 angled sharply relative to one another. Thus, perhaps only four, five or possibly six adjacent links may be needed to define a full 360 degree loop of the tongue, without interference between the adjacent links.

Inboard link 240 has an end flange 258 that is secured to a flange 261 formed on tube 262, to be in effect unitary therewith. The tube 262 itself is supported in the same manner the tube 62 was supported in FIGS. 1–12: to rotate about its longitudinal axis, relative to wall structures 70 and 72 of the body 12; to be axially restrained relative to the body; and to support a shaft 76 therewithin, that may be moved axially relative to the tube 262, but which is keyed nonrotatably relative to the tube 262 by pin 80 received in axial tube slot 82. Annular collar 84 is axially movable on the tube 262, being axially keyed to the shaft 76 by the pin 80.

A push-pull member 86 is extended substantially the full length of the tongue 230, fitted through axially aligned openings 288 in the links, being connected at its opposite ends to the shaft 76 and to the end link 242, but otherwise being axially slidable within and relative to all of the remaining links 238 and 240. The push-pull member 86 fits through the links at locations laterally offset from a longitudinal plane through the hinge sections 244, in the direction the tongue is to coil; and the hinge sections 244 lie close to the outer side edge 256 of the tongue.

The axial shifting of the shaft 76 is transmitted via the push-pull member 86 along the length of the tongue to the outboard end link 242, to coil or straighten the tongue. However, the hinge sections 244 will have some memory, which tends to straighten the tongue normally. Thus, the push-pull member 86 primarily is used to pull the tongue to the coiled position; and to push only when desired to bend the tongue beyond its straightened orientation, to reverse coil it, at least partly. To provide for this memory, such unitary tongue 230 may be formed of a polymer, having flexibility and strength, but yet some degree of memory to tend to return to its initially formed shape.

The tongue 230 is tapered, from its widest at inboard link 240, to its narrowest at the outboard link 242; and each intermediate link is of a varied width changing somewhat uniformily therebetween. This provides progressively stronger inboard hinge sections, compared to the outboard hinge sections; helping thereby in a desired operation of having the inboard links of the tongue uncoil first, and the outboard links of the tongue recoil first. Also, the inboard link 240 is longer than the outboard link 242, and each intermediate link is of a varied length somewhat uniformily therebetween. This allows the outboard end links of the tongue to be coiled in a tighter coil, compared to the inboard end links; and even to fit, when coiled, inside of the inboard end links, as illustrated in phantom in FIG. 14.

SUMMARY OF THE OPERATION

As illustrated, the toy creature 10 (and 210) has a mouth 18, with a tongue 30 (and 230) that can be coiled to fit within the month 18, but can also be extended to reach far beyond the forward edges 34 and 34 of the mouth. Moreover, the tongue can be manipulated by handle 78: to coil around and entrap some toy prey "P" illustrated in FIG. 1; to draw the prey back to the mouth 18; and size permitting, to draw the prey even into the mouth, and to close the upper jaw member 22 down over the captured prey, as if to eat the prey. The tongue will be of small cross section, relative to the size of the mouth 18, to fit in the mouth, while coiled, yet leaving some room to spare for the captured prey "P".

With the handle 78, and shaft 76, in the fully withdrawn or rearwardly retracted position (see FIGS. 2 and 3), collar rib 114 fits within actuator bar notch 108 to allow bar finger 116 to be inoperatively spaced from the underside surfaces of upper jaw member 22 . . . and provide that the mouth is closed, with the upper jaw member 22 resting on body stop 90. The tongue is also fully coiled, and within the closed mouth.

Upon initial forward movement of the shaft 76 into the body 12, some additional length of the push-pull member 86 is moved into the tongue links, to begin to uncoil the tongue links, with the inboard links straightening first. The mouth 18 begins to open too, upon collar rib 114 engaging the bar camming surface 110, initially to shift the bar 92 outwardly to position pin 96 against inboard edge 104 of the opening 98, then to lift the bar to position the pin 96 against lower opening edge 102 and the bar finger 116 against the underside surface 118 of the upper jaw member 22.

With the shaft 76 almost completely moved into the body 12 (see the position illustrated in phantom in FIG. 4), the tongue is almost fully extended, although the mouth 18 is opened only slightly. At this location, the camming surfaces 110 and 112 meet; so that continued outward movement of collar rib 114, now riding on the camming surface 112, allows the mouth to close, and rather rapidly too. See FIG. 6 for this operative position.

With the tongue fully extended, the toy and tongue may be manipulated to present the tongue adjacent a toy prey "P". In this regard, rotation of the handle 78 and shaft 76 will rotate the tube 62 (or 262); which in turn rotates the tongue 30 (or 230) to change the orientation of the axes 44 (or 244) about which the tongue links 38, 40 and 42 (or 238, 240 and 242) will coil, and the direction the tongue will pivot. In the solid illustration in FIG. 1, the tongue will be coiled to the right, or clockwise as viewed from the top, generally within a horizontal plane; although should the tube 62 be turned 180 degrees, the tongue 30 will be coiled to the left or counterclockwise as viewed from the top, but yet within a horizontal plane. A 90 degree twist of the handle 78, will cause the tongue to be coiled within a generally vertical plane; and any angle of handle twist, intermediate these extremes, will be possible, to control the direction of tongue coiling over a full 360 degree range.

With the tongue located adjacent the prey and having some slight degree of tongue overlap beyond the prey, upon rearwardly withdrawing the handle 78, the push-pull member 86 is partically withdrawn from the tongue links to begin to recoil the tongue 30 . . . the outboard paired links first, and the mouth 18 also begins to open. Thus, the collar rib 114 engaging the bar camming surface 112 initially shifts the lost motion bar 92 inwardly to position pin 96 against outboard edge 106 of the opening 98, and then lifts the bar finger 116 against the underside surface 120 of the upper jaw member 22. The ride of the collar rib 114 along the camming surfaces 112 then dramatically opens the mouth, fully and rapidly. This is caused because the jaw surface 120 is offset closer to the camming collar rib 114, and because the pivot pin 96 at the outboard edge 106 of the actuator bar 92 engages the upper opening edge 100.

Continued rearward withdrawal of the handle 78 to approximately the position of FIG. 12, recoils the tongue almost completely and the recoiled tongue is now completely within the mouth 18; but the mouth remains almost fully opened. To add to the realism and drama of the prey-catching feat of the toy creature, the mouth 18 is designed to be closed now, rapidly and dramatically, over the captured prey. Thus, the collar rib 114 leaves the camming surface 110 and enter the notch 108. This removes the support of the collar rib 114 against the actuator bar 92, and the consequent support of the actuator finger 116 against the upper jaw member 22. Moreover, the collar rib 114, in entering the notch, rides some way along the sloping forward edge of the notch, to kick the actuator bar 92 forwardly; so that the bar finger 116 now will underlie the other more set back offset surface 118.

It will be appreciated that the toy creature 10 may use many additional details in the construction of the body 12, to make it more realistic and/or menacing in appearance. However, as these do not relate to the overall invention, and are difficult to portray, they have not been included in the embodiment of the invention illustrated herein. These additions may include features such as skin or exterior surface texture or color, enlarged body or leg joints, moving eyes, ears, or the like. The entire toy creature may be mounted on wheels (not shown) for providing mobility on a flat supporting surface during use.

What we claim as our invention is:

1. A toy creature, comprising the combination of structure defining a mouth, including jaw members that can be moved relative to one another, between a first position with said jaw members spaced apart but generally parallel to one another, to simulate the mouth when closed, and a second position with said jaw members angled relative to one another, being furthest apart at the front of the toy, to simulate the mouth when opened;

means to move the mouth jaw members between said opened and closed position;

a tongue, and means securing the tongue at one end within the mouth;

said tongue being very much elongated, compared to the size of the mouth, to provide that a free end of the tongue opposite the tongue securing means may be extended to far beyond the edges of the mouth jaw members; and means for manipulating the tongue between a retracted position, where the tongue is coiled and fitted within the mouth and between the mouth jaw members, and an extended position, where the tongue is substantially straight and has the free end spaced far beyond the edges of the mouth jaw members; and the mouth moving means and the tongue manipulating means being operatively tied together, via a lost motion linkage, to provide that the mouth jaw members are opening the widest only as the tongue is being recoiled from the extended position to the retracted position, and the tongue manipulation, from the extended position to the retracted position, being operable to coil the tongue around and entrap some toy prey and to draw the prey back toward and into the mouth, as in eating the prey.

2. A toy creature according to claim 1, further including an operating member supported to be shifted in an axial direction manually by the user of the toy; and further wherein the mouth opening and closing means includes an actuating member movable axially also; cooperating cam means between the mouth and the actuating member engagable at respective axial positions of the actuating member for holding the mouth opened to varying degrees; and means supporting the actuating member, with said lost motion linkage, operable to be shifted by axial movement of the operating member, but differently upon movement of the operating member in opposite directions corresponding to uncoiling and recoiling said tongue, operable to have the mouth open its widest only as the tongue is being recoiled toward the mouth, to permit the opened mouth to accept any small captured prey.

3. A toy creature according to claim 2, wherein the mouth is sized to be sufficiently large to receive the coiled tongue, and size permitting, any small captured prey held within the coiled tongue; and wherein the lost motion linkage for the mouth opening and closing actuating member is adapted, as the coiled tongue has just been moved to within the mouth, to release the mouth and allow it to close rapidly over said small captured prey.

4. A toy creature according to claim 3, wherein said tongue is formed of a plurality of links each of relatively short length compared to the length of the tongue, means pivoting the links successively together end-to-end, said means for manipulating the tongue being in the form of a push-pull member extended substantially the full length of the tongue, one end of the push-pull member being connected to the outboard link at the free tongue end, means for guiding the push-pull member relative to each remaining link at locations laterally offset of the link pivoting means, and means for coupling the other end of the push-pull member to the operating member.

5. A toy creature, comprising the combination of structure defining a mouth;

a tongue, and means securing one end of the tongue generally in the mouth;

said tongue being very much elongated compared to the size of the mouth, to provide that the free end of the tongue opposite the tongue securing means may be extended to far beyond the mouth;

said tongue being formed of a plurality of links each of relatively short length compared to the length of the tongue, and means pivoting the links successively together end-to-end;

means for manipulating the tongue between a substantially straight orientation projecting from the mouth, and a coiled orientation, said means for manipulating the tongue:

being in the form of a push-pull member extended substantially the full length of the tongue, and means connecting one end of the push-pull member to the outboard tongue link and means for slidably coupling the push-pull member to each of the remaining links forming the tongue at locations laterally offset relative to the link pivoting means;

including an operating member and means supporting said operating member for movement axially of the extension of the tongue; a handle on said operating member that may be manually gripped and moved by the user of the toy, to correspondinly shift said operating member; and means for coupling the other end of the push-pull member to the operating member; and including means connecting the tongue to the operating member; means supporting said operating member to be rotated about the longitudional axis of the tongue, to provide that rotation of the operating member also rotates the tongue; and manual movement of the handle by the user of the toy, providing rotation of the operating member and adjustment of the direction the tongue will be uncoiled and recoiled; and the tongue manipulation being operable to coil the tongue around and entrap some toy prey and to draw the prey back toward the mouth, as in eating the prey.

6. A toy creature according to claim 5, wherein the structure defining the mouth may be shifted to open and close the mouth; means for opening and closing the mouth, said mouth opening and closing means being in operative association with the tongue manipulating means, operable to open the mouth wide upon the tongue being recoiled to carry any captured prey toward and into the mouth.

7. A toy creature, comprising the combination of structure defining a mouth, and means for opening and closing the mouth including axially movable actuating and operating members;

a tongue, and means securing one end of the tongue generally in the mouth;

said tongue being very much elongated compared to the size of the mouth, to provide that the free end of the tongue opposite the tongue securing means may be extended to far beyond the mouth;

said tongue being formed of a plurality of links each of relatively short length compared to the length of the tongue, and means pivoting the links successively together end-to-end;

means for manipulating the tongue between a substantially straight orientation projecting from the mouth, and a coiled orientation, said means for manipulating the tongue:

being in the form of a push-pull member extended substantially the full length of the tongue, and means connecting one end of the push-pull member to the outboard tongue link and means for slidably coupling the push-pull member to each of the remaining links forming the tongue at locations laterally offset relative to the link pivoting means;

including said operating member and a handle on said operating member that may be manually gripped and moved by the user of the toy, to correspondinly shift said operating member; and means for coupling the other end of the push-pull member to the operating member;

the tongue manipulation being operable to coil the tongue around and entrap some toy prey and to draw the prey back toward the mouth, as in eating the prey; and cooperating cam means between the mouth and the actuating member engagable at respective axial positions of the actuating member for holding the mouth opened to varying degrees; and lost motion connection means between the actuating and operating members, operable to shift the actuating member by axial movement of the operating member, but differently upon movement of the operating member in opposite directions corresponding to uncoiling and recoiling said tongue, operable to have the mouth open its widest only as the tongue is being recoiled toward the mouth, to permit the opened mouth to accept small captured prey, as if to eat the prey.

8. A toy creature, comprising the combination of structure defining a mouth, a tongue, and means securing one end of the tongue generally in the mouth;

said tongue being very much elongated compared to the size of the mouth, to provide that the free end of the tongue opposite the tongue securing means may be extended to far beyond the mouth;

means for manipulating the tongue:

between a substantially straight orientation projecting from the mouth, and a coiled orientation operable to coil around and entrap some toy prey and to draw the prey back toward the mouth, as in eating the prey; and to rotate about its longitudinal axis when it is in its substantially straight orientation to change the direction the tongue may be uncoiled and recoiled; and said manipulating means including an operating member, means supporting said operating member to move both axially and rotatably of the longitudinal axis of the tongue in its substantially straight orientation, and means connecting the operating member relative to the tongue;

means for opening and closing the mouth structure, said mouth opening and closing means being in operative association with the tongue manipulating means, operable to open the mouth its widest only upon the tongue being recoiled to carry any captured prey toward and into the mouth; and the tongue being adapted to be coiled to fit entirely within the mouth, when the mouth is closed.

9. A toy creature, comprising the combination of structure defining a mouth, a tongue, and means securing one end of the tongue generally in the mouth;

said tongue being very much elongated compared to the size of the mouth, to provide that the free end of the tongue opposite the tongue securing means may be extended to far beyond the mouth;

means for manipulating the tongue between a substantially straight orientation projecting from the mouth, and a coiled orientation operable to coil around and entrap some toy prey and to draw the prey back toward the mouth, as in eating the prey;

said manipulating means including an operating member, means supporting said operating member to move axially of the longitudinal axis of the tongue in its substantially straight orientation, a handle on said operating member that may be manually gripped and moved by the user of the toy to correspondinly shift said operating member, and means connecting the operating member relative to the tongue;

means for opening and closing the mouth structure, said mouth opening and closing means being in operative association with the tongue manipulating means, via a lost motion connection, operable to open the mouth its widest only upon the tongue being recoiled to carry any captured prey toward and into the mouth; and the tongue being adapted to be coiled to fit entirely within the mouth, when the mouth is closed.

10. A toy creature according to claim 9, wherein the mouth is sized to be sufficiently large to receive the coiled tongue, and size permitting, any small captured prey held within the coiled tongue; and wherein the lost motion connection for the mouth opening and closing actuating member is adapted, as the coiled tongue has just been moved to within the mouth, to release the mouth and allow it to close rapidly over said captured prey.

11. A toy creature according to claim 9, wherein the mouth opening and closing means includes an actuating member and means to support the actuating member for axial movement in line with the extension of the tongue; cooperating cam means between the mouth and actuating member engagable at respective axial positions of the actuating member, for holding the mouth opened to varying degrees; and means supporting the actuating member, with a lost motion connection, operable to be shifted by movement of the tongue manipulating means, but differently upon movement of the operating member in opposite directions corresponding to uncoiling and recoiling said tongue, operable to have the mouth open its widest only as the tongue manipulating means is being moved to recoil the tongue toward the mouth, to permit the opened mouth to accept small captured prey, as if to eat the prey.

12. A toy creature according to claim 11, wherein the mouth is sized to be sufficiently large to receive the coiled tongue, and size permitting, any small captured prey held within the coiled tongue; and wherein the lost motion connection for the mouth opening and closing actuating member is adapted, as the coiled tongue has just been moved to within the mouth, to release the mouth and allow it to close rapidly over said small captured prey.

13. A toy creature according to claim 11, wherein said tongue is formed of a plurality of links each of relatively short length compared to the length of the tongue, means pivoting the links successively together end-to-end, said means for manilipulating the tongue being in the form of a push-pull member extended substantially the full length of the tongue, and means connecting one end of the push-pull member to the outboard link at the free tongue end and for guiding the push-pull member relative to each remaining link at locations laterally offset of the link pivoting means.

* * * * *